US010029838B2

(12) United States Patent
Larsen

(10) Patent No.: US 10,029,838 B2
(45) Date of Patent: Jul. 24, 2018

(54) CLAMSHELL PACKAGE AND METHOD OF FORMING THE SAME

(71) Applicant: Sonoco Development, Inc., Hartsville, SC (US)

(72) Inventor: David William Larsen, DeKalb, IL (US)

(73) Assignee: Sonoco Development, Inc., Hartsville, SC (US)

( * ) Notice: Subject to any disclaimer, the term of this patent is extended or adjusted under 35 U.S.C. 154(b) by 69 days.

(21) Appl. No.: 14/660,521

(22) Filed: Mar. 17, 2015

(65) Prior Publication Data

US 2016/0272394 A1 Sep. 22, 2016

(51) Int. Cl.
*B65D 75/22* (2006.01)

(52) U.S. Cl.
CPC ..... *B65D 75/22* (2013.01); *B65D 75/225* (2013.01)

(58) Field of Classification Search
CPC ..... B65D 75/22; B65D 75/225; B65D 1/225; B65D 11/1833
See application file for complete search history.

(56) References Cited

U.S. PATENT DOCUMENTS

| | | | |
|---|---|---|---|
| 3,776,375 | A | 12/1973 | Rohdin |
| 4,183,446 | A | 1/1980 | Davis |
| 4,899,877 | A | 2/1990 | Kiernan |
| 4,955,527 | A | 9/1990 | Blackman et al. |
| 5,129,516 | A | 7/1992 | Theros |
| 5,257,708 | A | 11/1993 | Dubach |
| 5,441,150 | A | 8/1995 | Ma |
| 5,447,232 | A | 9/1995 | Chow |
| 5,890,594 | A | 6/1999 | Hansen et al. |
| 6,364,114 | B1 | 4/2002 | Glassman |
| D471,099 | S | 3/2003 | Yang |
| 6,554,147 | B1 | 4/2003 | Maida, Jr. et al. |
| 7,021,526 | B2 | 4/2006 | Nishkawa et al. |
| 7,287,660 | B2 | 10/2007 | Ramirez et al. |
| 7,353,948 | B1 | 4/2008 | McDonald |
| 7,753,205 | B2 | 7/2010 | Shibata et al. |
| 8,104,616 | B2 | 1/2012 | Dalea et al. |
| 8,371,468 | B2 | 2/2013 | Sellari et al. |
| 8,733,626 | B2 | 5/2014 | Learn |
| 8,899,434 | B2 | 12/2014 | Falkman |

OTHER PUBLICATIONS

Dordan.com web site, Bifold Packaging, accessed Dec. 15, 2014.
Dordan.com web site, Plastic Clamshell Packaging, accessed Dec. 15, 2014.

*Primary Examiner* — Stephen Castellano
(74) *Attorney, Agent, or Firm* — Miller, Matthias & Hull LLP

(57) ABSTRACT

A clamshell package that includes a first storage section with a first flange, a second storage section with a second flange, and a base section with first and second ends, and first and second sides. The first end includes a third flange and the second end includes a fourth flange. The first side is pivotably attached to the first storage section to enable the first storage section to pivot from an open to a closed position. When the first storage section is in the closed position, the first flange may securely connect to the second, third, and/or fourth flanges. The second side is pivotably attached to the second storage section to enable the second storage section to pivot from an open to a closed position. When the second storage section is in the closed position the second flange may securely connect to the first, third, and/or fourth flanges.

13 Claims, 7 Drawing Sheets

CLAMSHELL PACKAGE AND METHOD OF FORMING THE SAME

BACKGROUND

Today's conventional clamshell-type packaging can be snapped together to store contents when the two halves of the package are folded together (hereinafter "conventional clamshell-type packaging"). However, conventional clamshell-type packaging often lacks a suitable flat and stable base on which the package may stand upright. Thus, appended support structures (e.g., feet, legs, kick stands, etc.) must be added to the conventional clamshell-type packaging to allow the package to stand upright. Such appended support structures are often unattractive, difficult to form, and waist space both on the package and on the storage shelf.

While current bi-fold packages stand naturally (i.e., without an appended support structure), their flanges do not fit together in a "face-to-face" manner sealing the package. Rather, for a bi-fold package to be sealed, a separate sealing mechanism must be placed on the face of the package. However, this takes up valuable display area and is unattractive.

SUMMARY OF INVENTION

A clamshell package may include a first storage section and a second storage section, where the first storage section may include one or more first flange and the second storage section may include one or more second flange. The clamshell package may further include a base section having a first end and a second end that is opposite the first end, and a first side and a second side that is opposite the first side, the first end may include one or more third flange and the second end may include one or more fourth flange. The first side may be pivotably attached to the first storage section to enable the first storage section to pivot, relative to the base section, from a first open position to a first closed position. When the first storage section is in the first closed position, the one or more first flange may securely connect to the one or more third flange and the one or more fourth flange. The second side may be pivotably attached to the second storage section to enable the second storage section to pivot, relative to the base section, from a second open position to a second closed position. When the second storage section is in the second closed position the one or more second flange may securely connect to the one or more third flange and the one or more fourth flange.

According to another implementation, a clamshell package may include a first storage section and a second storage section, the first storage section may include one or more first flange and the second storage section may include one or more second flange. The clamshell package may further include a base section having a first end and a second end that is opposite the first end, and a first side and a second side that is opposite the first side, the first end may include one or more third flange and the second end may include one or more fourth flange. Moreover, the clamshell package may include a first hinge and a second hinge. The first side may be pivotably attached to the first storage section, via the first hinge, to enable the first storage section to pivot, relative to the base section, from a first open position to a first closed position. When the first storage section is in the first closed position, the one or more first flange may securely connect to the one or more third flange and the one or more fourth flange. The second side may be pivotably attached to the second storage section, via the second hinge, to enable the second storage section to pivot, relative to the base section, from a second open position to a second closed position. When the second storage section is in the second closed position the one or more second flange may securely connect to the one or more third flange and the one or more fourth flange.

According to another implementation, a clamshell package may include a first storage section and a second storage section, the first storage section may include a first flange and the second storage section including a second flange. The clamshell package may further include a base section having a first end and a second end that is opposite the first end, and a first side and a second side that is opposite the first side, the first end may include a third flange and the second end may include a fourth flange. The first side may be pivotably attached to the first storage section to enable the first storage section to pivot, relative to the base section, from a first open position to a first closed position. When the first storage section is in the first closed position, the first flange may securely connect to the third flange and the fourth flange to create one or more first seals. The second side may be pivotably attached to the second storage section to enable the second storage section to pivot, relative to the base section, from a second open position to a second closed position. When the second storage section is in the second closed position the second flange may securely connect to the third flange and the fourth flange to create one or more second seal. The first flange may securely connect to the second flange to create one or more third seals when the first storage section is in the first closed position and the second storage section is in the second closed position. A storage cavity may be created when the first storage section is in the first closed position and the second storage section is in the second closed position. The storage cavity may be completely sealed when the first storage section is in the first closed position and the second storage section is in the second closed position.

A method for forming a clamshell package may include contacting a sheet of material with a mold. The method may include the step of forming, based on contacting the sheet of material with the mold, a clamshell package that includes at least a first storage section, a second storage section, and a base section. The first storage section may be attached to the base section at a first attachment and the second storage section may be attached to the base section at a second attachment. The first attachment and the second attachment may be formed below a sheet plane associated with the sheet of material prior to forming the clamshell package. The method may include the step of cutting the clamshell package such that a first channel and a second channel are created. The first channel may enable the first storage section to pivot about the first attachment relative to the base section and the second channel may enable the second storage section to pivot about the second attachment relative to the base section.

DETAILED DESCRIPTION

Figure 1A:
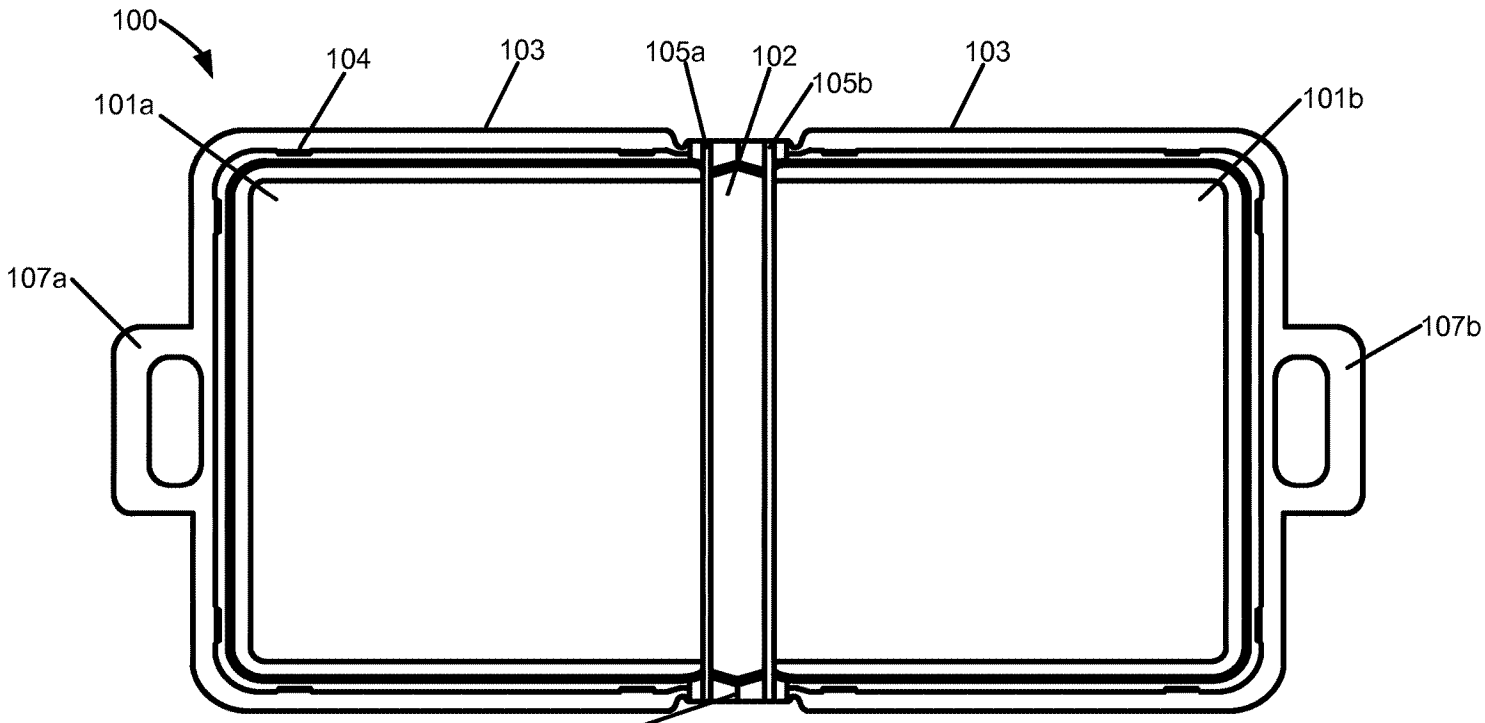
FIGS. 1A-C are diagrams of an example clamshell package according to an implementation described herein.

FIGS. 1A-4 are attached thereto and incorporated herein by this reference. The following detailed description refers to the accompanying FIGS. 1A-4. The same reference numbers in different figures may identify the same or similar elements.

An apparatus, system, method, technology, and/or technique, described herein, may include an improved clamshell package configured to store a content (hereinafter, "clamshell package"). For example, the clamshell package may include two or more storage sections, one or more base section, and one or more flange that enable the clamshell package to seal (e.g., close-off from outside environment, create water-tight seal, gas-tight seal, pressurized seal, temporary seal, etc.) the contents within the clamshell package. The storage sections may be pivotably attached to the base section to enable the storage sections to pivot from an open position to a closed position. When the storage sections are in their respective closed positions, one or more flange of the storage sections and/or base section may securely connect and create one or more seal. Secure connection of the storage sections and/or base section (e.g., via the flanges) may completely seal a storage cavity created by the storage sections (and/or the storage sections and base section) when the storage sections are in their respective closed position. Sealing the clamshell package may help protect the integrity of the content while being transported, carried, stored, displayed, etc. within the clamshell package, as well as help maintain the value of the content. Additionally, or alternatively, such seal may prevent unwanted contact with a content of the clamshell package to prevent scratching, abrasion and/or other forms of damage to the content or the clamshell package. Additionally, or alternatively, sealing the clamshell package may make it tamper resistant.

Additionally, or alternatively, the storage sections and base section may be pivotably attached via one or more hinge. One or more height associated with the hinges may be adjusted such that the clamshell package may better fit an intended content. The clamshell package may also, or alternatively, be formed in a shape that is similar or substantially similar to a shape of an intended content of the clamshell package. Additionally, or alternatively, the clamshell package may be formed in a shape that enables the clamshell package to stand without an appended support structure (e.g., feet, legs, kick stands, etc.).

The clamshell package may be formed by a method that includes contacting a sheet of material with a mold. The method may include forming, based on contacting the sheet of material with the mold, a clamshell package that includes at least a first storage section, a second storage section, and a base section. The first storage section may be attached to the base section at a first attachment and the second storage section may be attached to the base section at a second attachment. The first attachment and the second attachment may be formed below a sheet plane associated with the sheet of material prior to forming the clamshell package. The method may include the step of cutting the clamshell package such that a first channel and a second channel are created. The first channel may enable the first storage section to pivot about the first attachment relative to the base section and the second channel may enable the second storage section to pivot about the second attachment relative to the base section.

The clamshell package may be formed as one piece and the storage sections and base section may enable the clamshell package to be formed by less material than current bi-fold packaging. Additionally, or alternatively, because less material may be used in the clamshell package, the clamshell package may be lighter than current bi-fold packaging, which may reduce unit costs of the clamshell package and/or shipping costs of the clamshell package relative to that of the current bi-fold packaging.

The clamshell package is described and shown herein as generally rectangular in shape. However, the shape of the clamshell package need not be so limited. For example, as further described below, the clamshell package may include any shape (e.g., circle, triangle, square, ellipse, hexagon, octagon, cube, sphere, disk, cylinder, etc.) or any irregular shape to be similar, substantially similar, and/or dissimilar to a shape of an intended content of the clamshell package (e.g., bottle, canister, etc.).

Figure 1B:
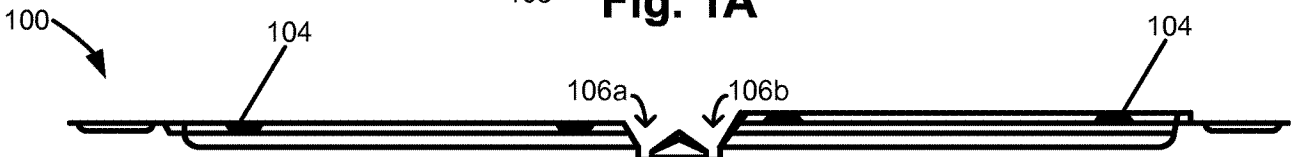
Figure 1C:
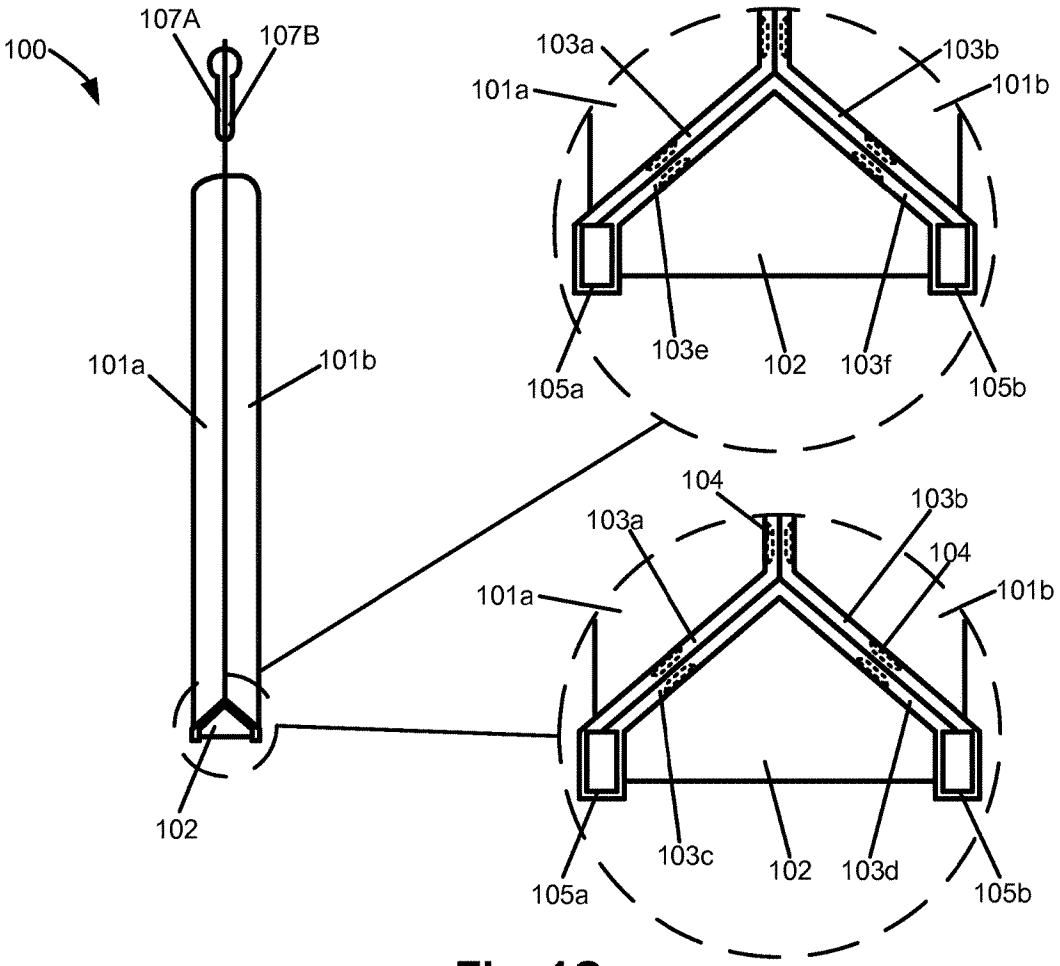

FIGS. 1A-1C are diagrams of an example clamshell package 100 (hereinafter, "clamshell package 100"). As shown in FIG. 1A, clamshell package 100 may include two or more storage sections 101*a*, 101*b* (hereinafter, "storage section 101*a*", "storage section 101*b*", or "storage sections 101") and one or more base section 102 (hereinafter, individually "base section 102" and collectively "base sections 102"). Base section 102 may include a first end and a second end that is opposite the first end, and a first side and a second side that is opposite the first side. The first side of base section 102 may be pivotably attached to storage section 101*a* (e.g., via hinge 105*a*, as described below) to enable storage section 101*a* to pivot, relative to base section 102, from an open position (as shown, e.g., in FIG. 1B) to a closed position (as shown, e.g., in FIG. 1C). The second side of base section 102 may be pivotably attached to storage section 101*b* (e.g., via hinge 105*b*, as described below) to enable storage section 101*b* to pivot, relative to base section 102, from an open position (as shown, e.g., in FIG. 1B) to a closed position (as shown, e.g., in FIG. 1C).

The number of components, illustrated in FIGS. 1A-C, is provided for explanatory purposes only and is not intended to be so limited. There may be additional components, fewer components, different components, or differently arranged components than illustrated in FIGS. 1A-C. Also, in some implementations, one or more of the components of clamshell package 100 may perform one or more functions described as being performed by another one or more of the components of clamshell package 100.

Storage sections 101 may be formed by a material of sufficient rigidity and strength to support the weight of a content of clamshell package 100 and/or any static and/or dynamic loads (e.g., forces, torques, tensions, compressions, etc.) imparted on storage sections 101 while using clamshell package 100. Storage sections 101 may, for example, be made of polymer (e.g., polyvinyl chloride ("PVC"), polyethylene terephthalate ("PET"), etc.), Teflon, acrylic, urethane, wood, metal, fiberglass, composite, paper, and/or any other material that is suitable to be formed into clamshell package 100, or a combination thereof. The strength and/or rigidity of the material may enable storage sections 101 to maintain a basic shape when being used and/or to enable various components to be attached to storage sections 101 and to be used.

Additionally, or alternatively, storage sections 101 may be configured to include any shape. For example, storage sections 101 may include edges, surfaces, and/or contours, that are straight and/or flat, as shown for example in FIGS. 1A-B, or curved in a concave and/or convex manner, as shown for example in FIGS. 3A-B. Storage sections 101 may include a combination of curvatures associated with a shape of an intended content of clamshell package 100. Additionally, or alternatively, storage sections 101 may include any shape (e.g., circle, triangle, square, ellipse, hexagon, octagon, cube, sphere, disk, cylinder, etc.) or any irregular shape to be similar, substantially similar, and/or dissimilar to a shape of an intended content of clamshell package 100 (e.g., bottle, canister, etc.). Additionally, or alternatively, storage sections 101 may include one or more shape that allows an intended content to be securely held by storage sections 101 (e.g., snapped into, etc.).

Base section 102 may be formed by a material of sufficient rigidity and strength to support the weight of a content of clamshell package 100 and/or any static and/or dynamic loads (e.g., forces, torques, tensions, compressions, etc.) imparted on base section 102 while using clamshell package 100. Base section 102 may, for example, be made of polymer (e.g., polyvinyl chloride ("PVC"), polyethylene terephthalate ("PET"), etc.), Teflon®, acrylic, urethane, wood, metal, fiberglass, composite, paper, and/or any other material that is suitable to be formed into clamshell package 100, or a combination thereof. The strength and/or rigidity of the material may enable base section 102 to maintain a basic shape when being used and/or to enable various components to be attached to base section 102 (e.g., storage sections 101, etc.) and to be used.

Additionally, or alternatively, base section 102 may be configured to include any shape. For example, base section 102 may include edges, surfaces and/or contours that are straight and/or flat, as shown for example in FIGS. 1A-B, or curved in a concave and/or convex manner. Base section 102 may include a combination of curvatures associated with a shape of an intended content of clamshell package 100. Additionally, or alternatively, base section 102 (and its ends and sides) may include any shape (e.g., circle, triangle, square, ellipse, hexagon, octagon, cube, sphere, disk, cylinder, etc.) or any irregular shape to be similar, substantially similar, and/or dissimilar to a shape of an intended content of clamshell package 100. Additionally, or alternatively, base section 101 may include one or more shape that allows an intended content to be securely held by base section 102 (e.g., snapped into, etc.).

Storage sections 101 and/or base section 102 may include one or more flange 103 that enable secure connection between sections 101 and/or base section 102. For example, as shown in FIG. 1C, storage section 101*a* may include one or more storage section flange 103*a* (hereinafter, "storage section flange 103*a*") and storage section 101*b* may include one or more storage section flange 103*b* (hereinafter, "storage section flange 103*b*"). Additionally, or alternatively, the first end of base section 102 may include one or more base section flange 103*c*, 103*d*, and/or the second end of base section 102 may include one or more base section flange 103*e*, 103*f* with a similar configuration. Storage section flange 103*a* may securely connect to at least a portion of the one or more base section flange 103*c*, 103*e* when storage section 101*a* is in a closed position. Storage section flange 103*b* may securely connect to at least a portion of the one or more base section flange 103*d*, 103*f* when storage section 101*b* is in a closed position. Additionally, or alternatively, storage section flange 103*a* may securely connect to storage section flange 103*b* when storage section 101*a* is in a closed position and storage section 101*b* is in a closed position.

Flange 103 may include one or more attachment mechanism 104 (hereinafter, "attachment mechanism 104") that may enable storage sections 101 and base section 102 to securely connect. Attachment mechanism 104 may include, for example without limitation, one or more button, snap, ridge, male/female connection, groove and tongue mechanism, buckle, glue, screws, staples, Velcro®, activated sealant, polymer linear, weld, and/or some other attachment mechanism.

Additionally, or alternatively, one or more seal may be created between storage sections 101 and/or base section 102 when storage sections 101 are in their respective closed positions. For example, with respect to the first end of base section 102, a first seal may be created between storage section flange 103*a* and at least a portion of one or more base section flange 103*c*, when storage section flange 103*a* securely connects to at least a portion of one or more base section flange 103*c*. A second seal may be created between storage section flange 103*b* and at least a portion of one or more base section flange 103*d*, when storage section flange 103*b* securely connects to at least a portion of one or more base section flange 103*d*. With respect to the second end of base section 102, a third seal may be created between storage section flange 103*a* and at least a portion of one or more base section flange 103*e* and/or a fourth seal may be created between storage section flange 103*b* and at least a portion of one or more base section flange 103*f*. Additionally, or alternatively, a fifth seal may be created between storage section flange 103*a* and storage section flange 103*b* when storage section flange 103*a* securely connects to storage section flange 103*b*. The one or more seal created between storage sections 101 and/or base section 102 may include, for example, a water-tight seal, gas-tight seal, pressurized seal, temporary seal, etc. Such seal may protect an intended content of clamshell package 100 from being exposed, compromised, damaged, or otherwise contacted through an unsealed portion of storage section 101*a*, 101*b*, base section 102, and/or other component of clamshell package 100.

As shown in FIGS. 1A-C, flange 103 may be located on the outer perimeter of storage sections 101 and/or base section 102. However, the location, size, and shape of flange 103 shown in the accompanying figures and described herein, are not intended to be limiting. For example, flange 103 may include edges that are straight or curved in a concave and/or convex manner. Flange 103 may also, or alternatively, include a combination of curvatures, any shape, or any irregular shape to be similar, substantially similar, and/or dissimilar to a shape of an intended content of clamshell package 100.

Additionally, or alternatively, the one or more flange 103*a* and 103*b* of storage section 101*a* and 101*b*, respectively, may be continuous or include non-continuous segments. The one or more base section flange 103*c*, 103*d*, 103*e*, 103*f* of base section 102 may be continuous and/or include non-continuous segments.

Clamshell package 100 may also, or alternatively, include one or more handle to allow clamshell package 100 to be carried, stored, displayed, etc. For example, as shown in FIG. 1A, handle portion 107*a* may be associated with storage section 101*a* and handle portion 107*b* may be associated with storage section 101*b*. Each handle portion 107*a*, 107*b* may include one or more handle flange (not shown) (and/or one or more attachment mechanism (not shown)) configured to enable handle portions 107*a*, 107*b* to securely connect to one another when storage sections 101 are in their respective closed positions. A seal may be created between handle portions 107*a*, 107*b* (e.g., via a secure connection between the handle flanges of handle portions 107*a* and 107*b*) when they are securely connected to one another. The size, shape, orientation, and location of handles 107 shown in the accompanying figures are not intended to be limiting.

Additionally, or alternatively, storage sections 101 and base section 102 may be pivotably attached via, for example, one or more hinge 105 (hereinafter, "hinge 105*a*", "hinge 105*b*", or "hinges 105"). Hinges 105 may include any pivotable attachment, including but not limited to folding lines, seams, mechanical joints, etc. Additionally, or alternatively, the axes of the pivotable attachments between storage sections 101 and base sections 102 may be parallel (e.g., as shown in FIG. 1A) or may be non-parallel, and may be straight or curved. Additionally, or alternatively, clamshell package 100 may include one or more hinge channel 106 (hereinafter, "hinge channel 106*a*", "hinge channel 106*b*", or collectively "hinge channels 106") that provide clearance for storage sections 101 to pivot to and from their respective open and closed positions. Hinge channels 106 may be formed in any suitable manner known in the art. For instance, hinge channels 106 may be formed during the molding process and cut (e.g., guillotine cut, laser cut, match-metal punch, etc.) out of the surrounding scrap material. Such form-and-guillotine process may be used for a clamshell package formed out of a single sheet of material. As shown in FIG. 1B, the contours (or boundaries) of hinge channels 106 may be straight (e.g., forming a triangular shape with a right angle). Additionally, or alternatively, in other implementations, the shape of the contours (or boundaries) of hinge channels 106 and/or the clearance provided by hinge channels 106 need not be so limited. For example, the contours (or boundaries) of hinge channels 106 and/or the clearance may be curved, or of any suitable shape, as long as storage sections 101 and/or base section 102 may securely connect.

As shown in FIGS. 1A-C, a height associated with hinge 105*a* may be equal to or approximately equal to a height associated with hinge 105*b*. Additionally, or alternatively, the shape of hinge channels 106 may be the same or approximately the same and/or the size of hinge channels 106 may be the same or approximately the same. Additionally, or alternatively, base section 102 may enable clamshell package 100 to stand without an appended support structure (e.g., feet, legs, kick stands, etc.) when storage sections 101 are in their respective closed positions. For example, base section 102 may include a bottom surface that is substantially flat and/or balanced. Additionally, or alternatively, clamshell package 100 may stand upright on hinges 105.

Figure 2A:
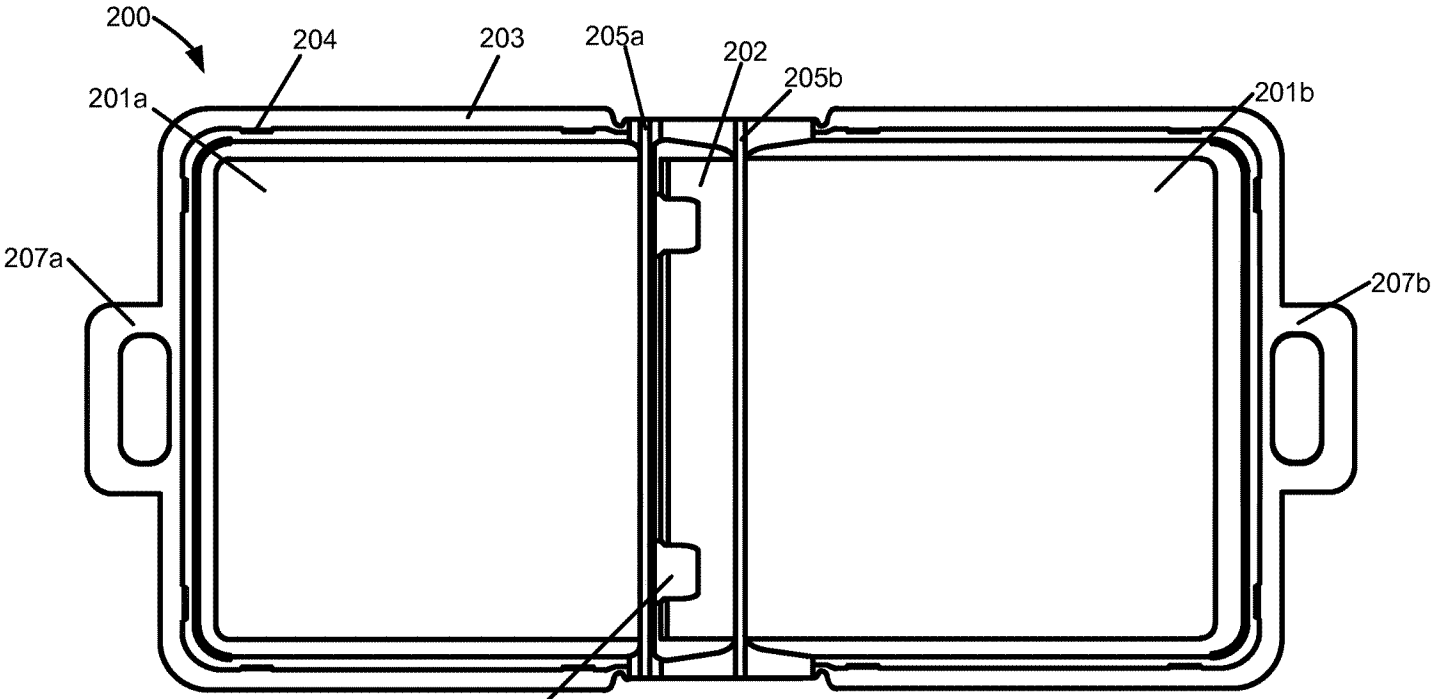
FIGS. 2A-E are diagrams of an example clamshell package with adjusted hinge height according to an implementation described herein.
Figure 2B:
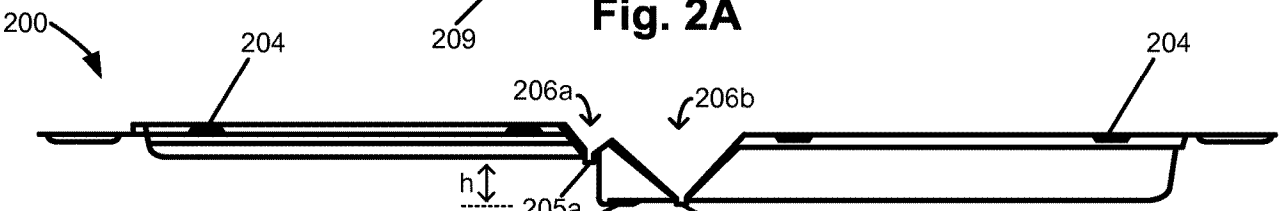

FIGS. 2A-E are diagrams of an example clamshell package 200 with adjusted hinge height. As shown in FIG. 2A, clamshell package 200 may include two or more storage sections 201*a*, 201*b* (hereinafter, "storage section 201*a*", "storage section 201*b*", or "storage sections 201") and one or more base section 202 (hereinafter, individually "base section 202" and collectively "base sections 202"). Base section 202 may include a first end and a second end that is opposite the first end, and a first side and a second side that is opposite the first side. The first side of base section 202 may be pivotably attached to storage section 201*a* (e.g., via hinge 205*a*) to enable storage section 201*a* to pivot, relative to base section 202, from an open position (as shown, e.g., in FIG. 2B) to a closed position (as shown, e.g., in FIG. 2D). The second side of base section 202 may be pivotably attached to storage section 201*b* (e.g., via hinge 205*b*) to enable storage section 201*b* to pivot, relative to base section 202, from an open position (as shown, e.g., in FIG. 2B) to a closed position (as shown, e.g., in FIG. 2C).

Additionally, or alternatively, storage sections 201 and/or base section 202 may include one or more flange 203 that enable secure connection between storage sections 201 and/or base section 202, in a manner similar to that described above with respect to FIGS. 1A-C. Additionally, or alternatively, one or more seal 208 may be created between storage sections 201 and/or base section 202 (e.g., via one or more flange 203) when storage sections 201 are in their respective closed positions, in a manner similar to that described above with respect to FIGS. 1A-C.

Hinges 205 may include any pivotable attachment, including but not limited to folding lines, seams, mechanical joints, etc. Additionally, or alternatively, clamshell package 200 may include one or more hinge channel 206 (hereinafter, "hinge channel 206*a*", "hinge channel 206*b*", or collectively "hinge channels 206") that provide clearance for storage sections 201 to pivot to and from their respective open and closed positions. Hinges 205 and hinge channels 206 may include any shape and be formed in a manner similar to that described above with respect to FIGS. 1A-C.

Figure 2C:
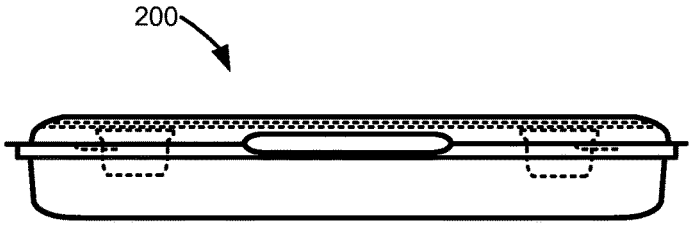
Figure 2D:
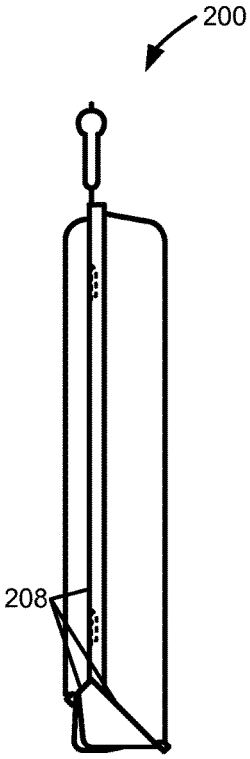
Figure 2E:
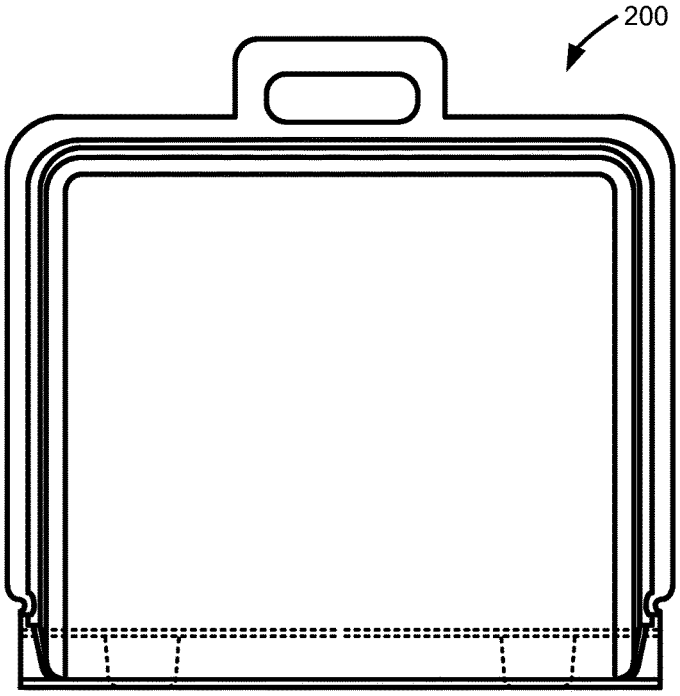

As shown in FIGS. 2A-E, the heights associated with the one or more hinge may be different. For example, in one non-limiting implementation, a height ("h") associated with hinge 205*a* (e.g., as defined by a vertical distance from hinge 205*a* to a bottom surface of base section 202, ground, floor, or etc.) may not be equal or approximately equal to a height associated with hinge 205*b* (e.g., as defined by a vertical distance from hinge 205*b* to a bottom surface of base section 202, ground, floor, or etc.). The height ("h") associated with hinge 205*a* may be greater or less than the height associated with hinge 205*b*. Additionally, or alternatively, the shape of hinge channel 206*a* may be different from the shape of hinge channel 206*b* and/or the size of hinge channel 206*a* may be different from the size of hinge channel 206*b*. Base section 202 may also, or alternatively, include one or more protrusion 209 configured to enable clamshell package 200 to stand upright when storage section 201*a* is in a closed position and storage section 201*b* is in a closed position, as shown in FIGS. 2C-E.

By adjusting one or more height associated with hinges 205, and thus the orientation of storage sections 201, clamshell package 200 may better fit an intended content. For example, adjustment of one or more height associated with hinges 205 may shift the location of the mating plane or the interface where secure connection between storage sections 201 takes place. As shown in FIG. 1C, a height associated with hinge 105*a* may be equal to or approximately equal to a height associated with 105*b*, and the location of the mating plane or the interface where secure connection between storage sections 101 takes place may be centered with respect to base section 102, while storage sections 101 are in their respective closed positions. In FIG. 2D, a height associated with hinge 205*a* may be higher or greater than a height associated with hinge 205*b*, and the location of the mating plane or the interface where secure connection between storage sections 201 takes place may be off-center (e.g., located left of center) with respect to base section 202. In other implementations, a height associated with hinge 205*a* and/or a height associated with hinge 205*b* may be adjusted such that the mating plane or the interface where secure connection between storage sections 201 takes place may be located in other off-center configurations (e.g., right of center) with respect to base section 202. Additionally, or alternatively, adjustment of one or more height associated with hinges 205 may help further control where an intended content may be stored within clamshell package 200 (e.g., majority of content in storage section 201*a*, majority of content in 201*b*, increase distance from the bottom of base section 202). Additionally, or alternatively, this may further increase customization of the shape and configuration of clamshell package 200 to be more appropriate for intended displays, desired shipping methods, and/or available storage means, etc. Additionally, or alternatively, adjustment of one or more height associated with hinges 205 may increase the distance of one or more hinge 205 from a ground or floor and protect hinges 205 from any unwanted substance on the ground or floor (e.g., water, sewage, dirt, etc.).

The number of components, illustrated in FIGS. 2A-E, is provided for explanatory purposes only and is not intended to be so limited. There may be additional components, fewer components, different components, or differently arranged components than illustrated in FIGS. 2A-E. Also, in some implementations, one or more of the components of clamshell package 200 may perform one or more functions described as being performed by another one or more of the components of clamshell package 200.

Figure 3A:
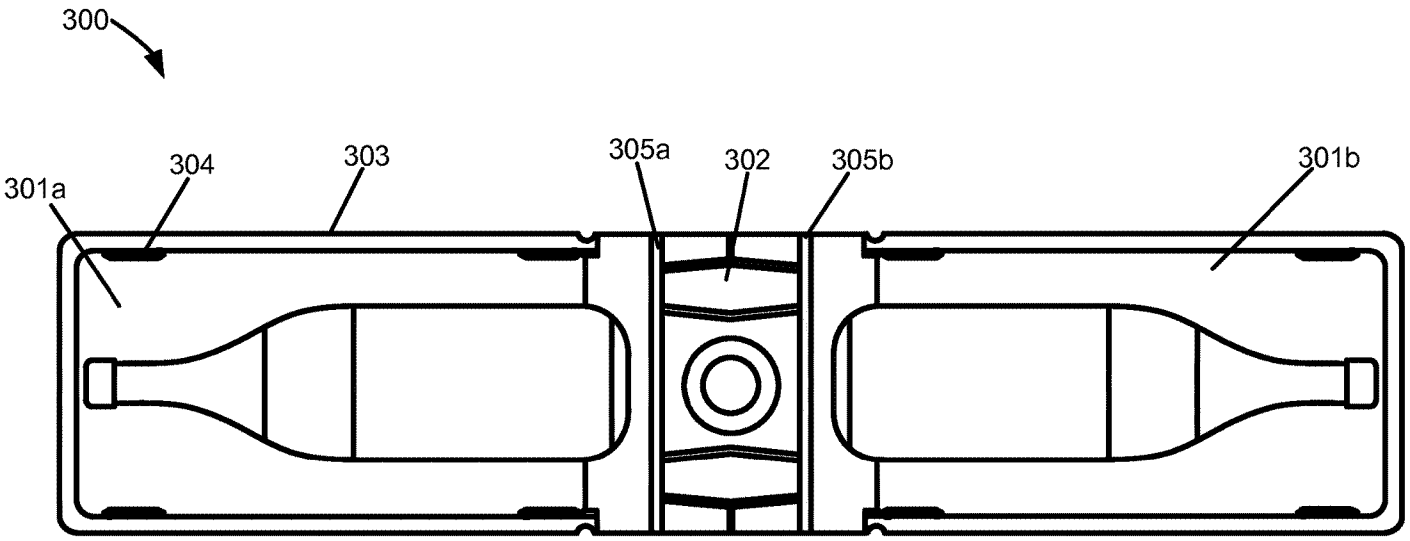
FIGS. 3A-C are diagrams of an example clamshell package that may be formed in a shape that is similar to a shape of an intended content of the example clamshell package according to an implementation described herein.
Figure 3B:
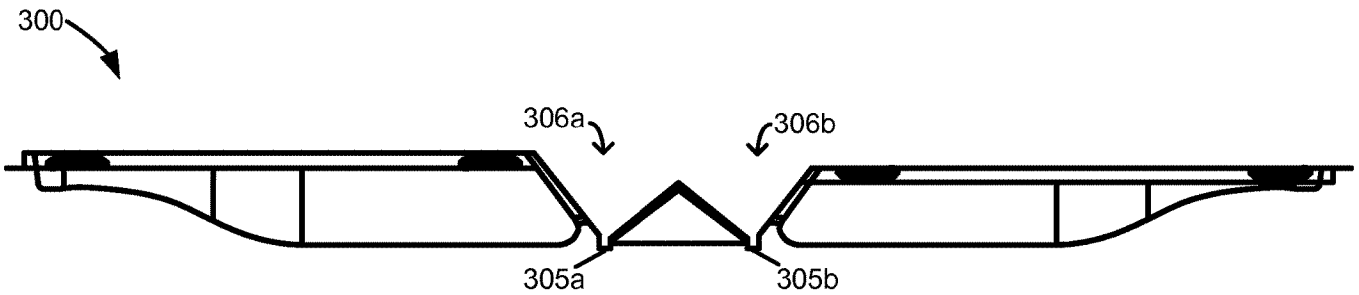
Figure 3C:
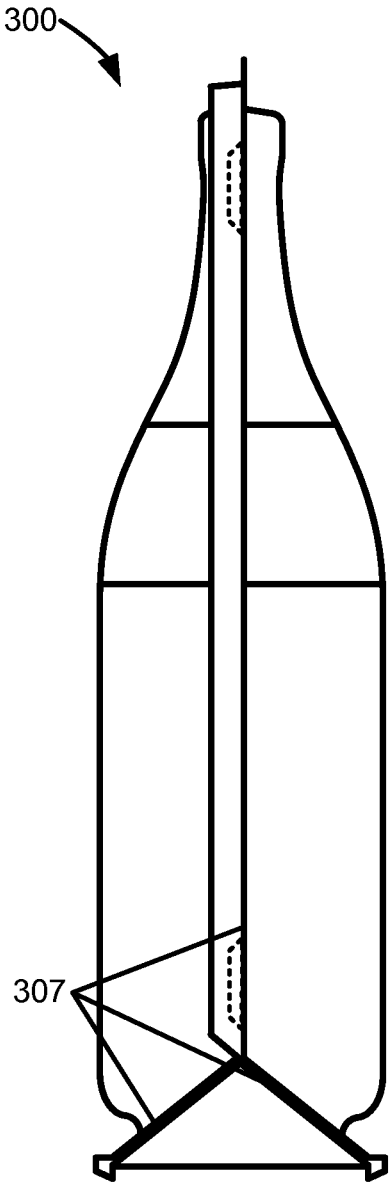

FIGS. 3A-C are diagrams of an example clamshell package 300 that includes a shape that is similar and/or substantially similar to a shape of an intended content. Clamshell package 300 may include two or more storage sections 301*a*, 301*b* (hereinafter, "storage section 301*a*", "storage section 301*b*", or "storage sections 301") and one or more base section 302 (hereinafter, individually "base section 302" and collectively "base sections 302"). Base section 302 may include a first end and a second end that is opposite the first end, and a first side and a second side that is opposite the first side. The first side of base section 302 may be pivotably attached to storage section 301*a* (e.g., via hinge 305*a*) to enable storage section 301*a* to pivot, relative to base section 302, from an open position (as shown, e.g., in FIG. 3B) to a closed position (as shown, e.g., in FIG. 3C). The second side of base section 302 may be pivotably attached to storage section 301*b* (e.g., via hinge 305*b*) to enable storage section 301*b* to pivot, relative to base section 302, from an open position (as shown, e.g., in FIG. 3B) to a closed position (as shown, e.g., in FIG. 3C).

Additionally, or alternatively, storage sections 301 and/or base section 302 may include one or more flange 303 that enable secure connection between storage sections 301 and/or base section 302, in a manner similar to that described above with respect to FIGS. 1A-C. Additionally, or alternatively, one or more seal 307 may be created between storage sections 301 and/or base section 302 (e.g., via one or more flange 303) when storage sections 301 are in their respective closed positions, in a manner similar to that described above with respect to FIGS. 1A-C.

Hinges 305 may include any pivotable attachment, including but not limited to folding lines, seams, mechanical joints, etc. Additionally, or alternatively, clamshell package 300 may include one or more hinge channel 306 (hereinafter, "hinge channel 306*a*", "hinge channel 306*b*", or collectively "hinge channels 306") that provide clearance for storage sections 301 to pivot to and from their respective open and closed positions. Hinges 305 and hinge channels 306 may include any shape and be formed, in a manner similar to that described above with respect to FIGS. 1A-C, and/or FIGS. 2A-E.

As shown in FIGS. 3A-C, storage sections 301 (like storage sections 101, 201) may be formed to define a storage cavity, when storage section 301*a* is in a closed position and storage section 301*b* is in a closed position. The storage cavity may include any shape and/or volume (e.g., circle, triangle, square, ellipse, hexagon, octagon, cube, sphere, disk, cylinder, etc.) or any irregular shape and/or volume to be similar and/or substantially similar to a shape, volume, contour, etc. of an intended content of clamshell package 300 (e.g., bottle, canister, etc.). The storage cavity may also or alternatively include any shape and/or volume or any irregular shape and/or volume that is dissimilar to a shape, volume, contour, etc. of an intended content of clamshell package 300. For example, an intended content may include a box of wine, while a shape of clamshell package 300 may include a shape of a wine bottle to inform a customer that the box of wine is of the same quality as a bottle of wine. Additionally, or alternatively, base section 302 (like base section 102, 202) may, along with storage sections 301 (or 101, 201), define a storage cavity.

Storage section 301*a* and/or 301*b* may include sufficient depth such that when storage sections 301 are in their respective closed positions an intended content of clamshell package 300 may be enclosed within a storage cavity created by storage sections 301 (or storage sections 301 and base section 302).

The number of components, illustrated in FIGS. 3A-C, is provided for explanatory purposes only and is not intended to be so limited. There may be additional components, fewer components, different components, or differently arranged components than illustrated in FIGS. 3A-C. Also, in some implementations, one or more of the components of clamshell package 300 may perform one or more functions described as being performed by another one or more of the components of clamshell package 300.

Additionally or alternatively, clamshell package 100 of FIGS. 1A-C, 200 of FIGS. 2A-E and/or 300 of FIGS. 3A-C may include clear and/or translucent material such that an intended content of clamshell package 100, 200 and/or 300, respectively, may be visible when stored in the storage cavity. Clamshell package 100, 200 and/or 300 may also, or alternatively, include graphics (e.g., related to a content, manufacturer, distributer, retail store, etc.). Additionally, or alternatively, clamshell package 100, 200 and/or 300 may include opaque material such that an intended content may not be visible when stored within clamshell package 100. Additionally, or alternatively, clamshell package 100 may include one or more perforations to, for instance, enable clamshell package 100, 200 and/or 300 to be carried, stored, displayed, include a "try-me" or "touch-me" cut-out, etc.

Clamshell package 100, 200 and/or 300 may also, or alternatively, include RFID devices, barcodes, and/or other security and/or tracking mechanisms to enable clamshell package 100 to be electronically tracked and/or identified.

Figure 4:
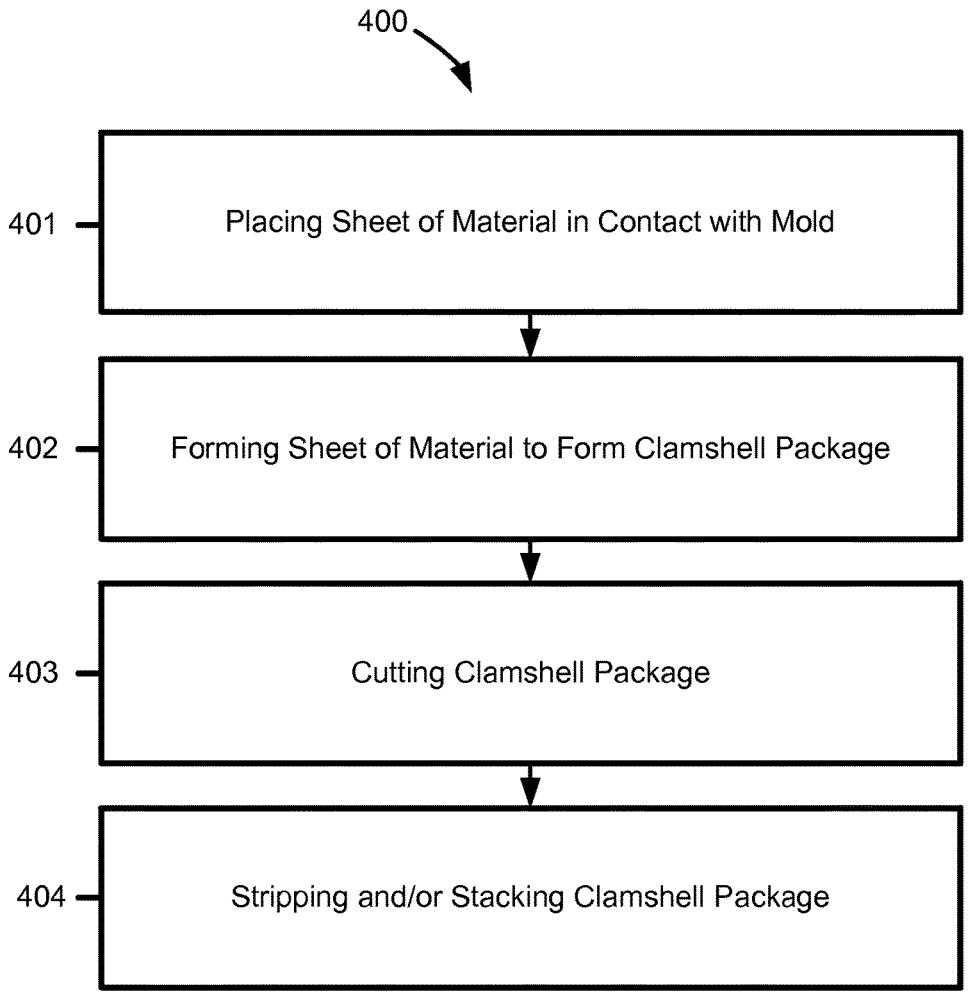
FIG. 4 is a flowchart of an example process for forming the clamshell package of FIGS. 1A-C, the clamshell package of FIGS. 2A-E, and/or the clamshell package of FIGS. 3A-C according to an implementation described herein.

FIG. 4 is a flowchart of example process 400 for forming a clamshell package. Step 401 may include placing one or more sheet of material (hereinafter, "a sheet" or "the sheet") in contact with one or more mold (hereinafter, "a mold" or "the mold"). The mold may include only one or more female cavity. Additionally, or alternatively, the mold may include one or more female cavity and one or more male form. For example, the mold may include one or more shape and/or cavity such that at least a first storage section, a second storage section, and a base section may be formed from a sheet of material. The mold may include one or more shape and/or cavity such that the first storage section is attached to the base section at a first attachment and the second storage section is attached to the base section at a second attachment. One or more shape and/or cavity of the mold may enable the first attachment and the second attachment to be formed below a sheet plane. The sheet plane may, for example, be associated with the sheet of material prior to forming the clamshell package. Additionally, or alternatively, the sheet plane may be associated with a top surface of the mold.

Step 402 may include forming the sheet of material to form a clamshell package that includes at least a first storage section, a second storage section, and a base section. The first storage section may be attached to the base section at a first attachment and the second storage section may be attached to the base section at a second attachment. The first attachment and the second attachment may be formed below a sheet plane associated with the sheet of material prior to forming the clamshell package. Additionally, or alternatively, the sheet plane may be associated with a top surface of the mold.

Step 402 may include a forming process (e.g., pressure forming, vacuum forming, plug-assist forming, etc.). Additionally, or alternatively, step 402 may include thermoforming. The temperature of the sheet of material may be adjusted. For example, the sheet of material may be heated such that it is more easily formable (e.g., pliable, etc.). Additionally, or alternatively, the temperature of the mold may be adjusted. For example, the mold may be cooled such that the sheet of material may harden when placed in contact with the mold and/or the mold may be capable of conducting heat (e.g., pulling heat off of the formed sheet of material, etc.). Additionally, or alternatively, the mold may be heated. Additionally, or alternatively, the temperature of the surrounding environment of the sheet of material and/or the mold may be adjusted.

Step 403 may include cutting the clamshell package. For example, a first cut (e.g., 3-D, guillotine, laser, match-metal punch, etc.) may be used to create at least two channels (e.g., by cutting material that has crossed the first and/or second attachments, etc.). A first channel may enable the first storage section to pivot about the first attachment relative to the base section, and a second channel may enable the second storage section to pivot about the second attachment relative to the base section. A second cut (e.g., a perimeter cut, 2-D, steal rule (d) knife (SRK) cut, cut normal to the sheet plane, laser cut, match-metal punch, etc.) may be used to remove excess material in the sheet plane. The sequence of the first cut and the second cut is not intended to be limiting. The second cut may occur prior to the first cut, the first cut may occur prior to the second cut, or the first cut and the second cut may be performed in parallel and/or concurrently or substantially concurrently (e.g., by laser cut, match-metal punch, etc.). One or more flange of the storage sections and/or base section may be formed during step 402 and cut to one or more desired shape and/or size in step 403.

At step 404, the clamshell package may be stripped and/or stacked. For example, if excess material is not fully disconnected from the clamshell package, the excess material may be stripped from the clamshell package (e.g., by a stripping mechanism, push-plug, etc.). Additionally, or alternatively, the clamshell package may be moved to a stacking plate (e.g., by a moving mechanism, push plug, etc.) for stacking.

The order and timing of the steps of process 400, as shown in FIG. 4, are not intended to be limiting. The order of steps 401-404 may be modified in other implementations, non-dependent steps may be performed in parallel, and/or other steps, not-shown, may be included. For example, the steps of cutting, stripping, and/or stacking may be performed in parallel and/or concurrently or substantially concurrently. Additionally, or alternatively, the order and timing of steps 401 and 402 may be adjusted. For example, a plug-assist may contact the sheet of material before and/or during contact with the mold to adjust the distribution of material on the mold.

This process provides several advantages. For example, by forming the first and second attachments below the sheet plane and cutting in the manner described above, the flanges of the storage sections are enabled to securely connect to the flanges of the base section (and/or the other storage section) when the storage sections are in their respective closed positions. In current bi-fold packaging, however, flanges of the storage sections are formed in the sheet plane and crush-cut to allow bending. Thus, in current bi-fold packaging the flanges of one storage section formed in the sheet plane cannot securely connect to the flanges of the other storage section formed in the sheet plane. Further, in the current invention, all machining may be normal to the flange, thus requiring no sign work, and reducing costs and complexity of manufacturing.

Clamshell package 100, 200 and/or 300 may be formed as one piece and may be formed by any other suitable plastics molding process known in the art for formation of such package. Additionally, or alternatively, forming of clamshell package 100, 200 and/or 300 may require less material than current bi-fold packaging. For example, current bi-fold packaging is formed with both a male form and a female cavity such that material must be distributed up the wall of the male form and then back down into the female cavity during the molding process. The mold for forming clamshell package 100, 200 and/or 300, on the other hand, may include only one or more female cavity, and thus require less material than current bi-fold packaging. Additionally, or alternatively, clamshell package 100, 200, and/or 300 may involve a reduction of surface area from current bi-fold packaging, leading to less material distribution. For example, in forming clamshell package 100, 200, and/or 300 a thinner gauge of material can be used, thus saving material. Also, during forming, less material distribution leads to less problems distributing the material (e.g., less thin spots, less blown holes, etc.).

The method for forming a clamshell package described above may be implemented by any known, suitable package forming system. For example, the system may include, without limitation, one or more mold, one or more heating and/or cooling source, one or more cutting mechanism (e.g., laser, knife, etc.), and one or more device configured to transport the clamshell package for stacking. The system may include a mechanism for forming a sheet of material to form a clamshell package (e.g., a pressure forming device, vacuum source, or plus-assist mechanism, etc.) and any AC/DC power source. The one or more mold may be made of any material suitable to withstand temperature adjustment and suitable to allow the formation of multiple clamshell packages.

The foregoing description provides illustration and description, but is not intended to be exhaustive or to limit the implementations to the precise form disclosed. Modifications and variations are possible in light of the above disclosure or may be acquired from practice of the embodiments.

It will be apparent that the apparatus, systems, methods, technologies and/or techniques, as described above, may be implemented in many different forms of hardware and/or materials in the implementations illustrated in the figures. The actual or specialized hardware and/or materials used to implement these the apparatus, systems, methods, technologies and/or techniques is not limiting of the embodiments—it being understood that hardware and/or materials can be designed to implement the apparatus, systems, methods, technologies and/or techniques based on the description herein.

It should be emphasized that the terms "comprises"/"comprising" when used in this specification are taken to specify the presence of stated features, integers, steps or components but does not preclude the presence or addition of one or more other features, integers, steps, components or groups thereof.

Even though particular combinations of features are recited in the claims and/or disclosed in the specification, these combinations are not intended to limit the disclosure of the embodiments. In fact, many of these features may be combined in ways not specifically recited in the claims and/or disclosed in the specification. Although each dependent claim listed below may directly depend on only one other claim, the disclosure of the embodiments includes each dependent claim in combination with every other claim in the claim set.

No element, act, or instruction used in the present application should be construed as critical or essential to the embodiments unless explicitly described as such. Also, as used herein, the article "a" and "an" are intended to include one or more items and may be used interchangeably with "one" or "more." Where only one item is intended, the term "one" or similar language is used. Further, the phrase "based on" is intended to mean "based, at least in part, on" unless explicitly stated otherwise.

What is claimed is:

1. A clamshell package comprising:

a first storage section and a second storage section, the first storage section including one or more first flange and the second storage section including one or more second flange; and a base section having a first end and a second end that is opposite the first end, and a first side and a second side that is opposite the first side, the first end including one or more third flange and the second end including one or more fourth flange, the first side being pivotably attached to the first storage section to enable the first storage section to pivot, relative to the base section, from a first open position to a first closed position, when the first storage section is in the first closed position, the one or more first flange securely connects, via a first attachment mechanism, to the one or more third flange and the oneor more fourth flange, and the second side being pivotably attached to the second storage section to enable the second storage section to pivot, relative to the base section, from a second open position to a second closed position, when the second storage section is in the second closed position, the one or more second flange securely connects, via a second attachment mechanism, to the one or more third flange and the oneor more fourth flange, wherein the first attachment mechanism or second attachment mechanism includes one or more of a snap.

2. The clamshell package according to claim 1, here a first seal is created when the one or more first flange securely connects to the one or more third flange, a second seal is created when the one or more first flange securely connects to the one or more fourth flange.

3. The clamshell package according to claim 1, where a first seal is created when the one or more second flange securely connects to the one or more third flange, and a second seal is created when the one or more second flange securely connects to the one or more fourth flange.

4. The clamshell package according to claim 1, where, when the first storage section is in the first closed position and the second storage section is in the second closed position, the one or more first flange securely connects, via a third attachment mechanism, to the one or more second flange.

5. The clamshell package according to claim 4, where a seal is created when the one or more first flange securely connects to he one or more second flange.

6. The clamshell package according to claim 1, where the first side is pivotably attached to the first storage section via a first hinge and the second side is pivotably attached to the second storage section via a second hinge.

7. The clamshell package according to claim 6, where a first height, associated with the first hinge, is approximately equal to a second height associated with the second hinge.

8. The clamshell package according to claim 6, where a first height associated with the first hinge is not approximately equal to a second height associated with a second hinge.

9. The clamshell package according to claim 6, further comprising a first hinge channel, associated with the first hinge, and a second hinge channel associated with the second hinge, the first hinge channel enabling first storage section to pivot, via the first hinge, relative to the base section, and the second hinge channel enabling the second storage section to pivot, via the second hinge, relative to the base section.

10. The clamshell package according to claim 9, where a shape of the first hinge channel is approximately the same as a shape of the second hinge channel, and where a size of the first hinge channel is approximately the same as a size of the second hinge channel.

11. The clamshell package according to claim 9, where a shape of the first hinge channel is different from a shape of the second hinge channel or where a size of the first hinge channel is different from a size of the second hinge channel.

12. The clamshell package according to claim 1, further comprising a first hinge channel and a second hinge channel, the first hinge channel enabling the first storage section to pivot relative to the base section, and the second hinge channel enabling the second storage section to pivot relative to the base section.

13. The clamshell package according to claim 1, where the base section enables the clamshell package to stand upright when the first storage section is in the first closed position and the second storage section is in the second closed position.

* * * * *